US006164040A

United States Patent [19]

Bowman, Jr. et al.

[11] Patent Number: 6,164,040

[45] Date of Patent: Dec. 26, 2000

[54] CARTONER WITH INK JET CODER

[75] Inventors: Richard E. Bowman, Jr., Quinton; Steven M. Campbell, Richmond; Ricky N. Cooper, Chesterfield; Robert C. Kucera, Jr., Aylett; Steven R. Rinehart, Chesterfield; Richard N. Webb, Richmond, all of Va.; Stephen D. Brown, Johnson City, Tenn.

[73] Assignee: Philip Morris Incorporated, New York, N.Y.

[21] Appl. No.: 09/056,347

[22] Filed: Apr. 7, 1998

[51] Int. Cl.[7] ..... B65B 61/02; B65B 61/26

[52] U.S. Cl. ..... 53/411; 53/505; 53/131.4; 53/389.1

[58] Field of Search ..... 53/411, 466, 505, 53/131.4, 228, 389.1

[56] References Cited

U.S. PATENT DOCUMENTS 5,193,328 3/1993 Boriani et al. ..... 53/228
5,588,281 12/1996 Boriani et al. ..... 53/466
5,810,487 9/1998 Kano et al. ..... 53/411

FOREIGN PATENT DOCUMENTS

WO 91/10595 7/1991 European Pat. Off. ..... 53/131.4

*Primary Examiner*—Peter Vo
*Assistant Examiner*—Louis K. Huynh
*Attorney, Agent, or Firm*—Burns, Doane, Swecker & Mathis, LLP

[57] ABSTRACT

A cigarette cartoner apparatus comprising a folding station configured to wrap a carton blank about a pre-arranged bundle of cigarette packets; means for repetitively dispensing carton blanks along a pathway; a signal generator adjacent a print location along the aforementioned pathway; at least one fluid jet print head adjacent the print location; a controller configured to operate the print head responsively to the signal generator; and a guide arrangement within the cartoner defining a contact-free path portion as the packaging material is progressed from said print location.

9 Claims, 7 Drawing Sheets

CARTONER WITH INK JET CODER

FIELD OF THE INVENTION

The present invention relates generally to ink jet printing information on cigarette packaging, and more particularly to apparatus and methods of applying pre-selected information on cigarette cartons utilizing ink jet technology.

BACKGROUND OF THE INVENTION

In cigarette production, individual packets of cigarettes are enwrapped in cellophane, collated into pairs and the pairs collated into groups of a pre-selected total number (usually 10 packets) before being further enwrapped within a carton blank. The carton wrapping operation itself, is automated utilizing a machine such as the G.D 4350 cartoner machine or a commercial equivalent.

In the past, information concerning the product, such as its time and/or place of manufacture, was embossed or otherwise applied to an outer flap of the carton using an embossing roller. In that the board material of the carton blank is fairly rigid, and the aforementioned embossing operation was executed without any ink, the embossed information was often difficult to read, and required close inspection of each carton to the substantial inconvenience of the reader.

A particular problem associated in applying inked indicia upon cigarette cartons or similar packaging is that cigarette packing operations are conducted at high machine speeds such that any on-line printing operation tends to cause ink smears both upon the finished cigarette product and upon portions of the packing machinery adjacent the print location. The latter situation compromises quality of the product and may lead to additional rejection of product and other manufacturing inefficiencies. Ink smears on the manufacturing machinery necessitates clean-up, taking the machine out of production and so creating additional costs.

Another difficulty in attempting on-line printing operations within a cigarette packing machine is that placement of the printing apparatus may interfere with smooth and consistent feeding of the packaging material.

Still another difficulty in attempting to execute on-line printing operations within a cigarette cartoner machine is that the ink jet printer best operates when the target material is moving at a fixed velocity, yet near the conclusion of wrapping operations, the carton and packet collation move along the final portion of the cartoner machine intermittently.

OBJECT AND SUMMARY OF THE INVENTION

Accordingly, it is an object of the present invention to provide a novel method and apparatus of applying pre-selected printed indicia upon an outer portion of cigarette cartons, on an on-line basis in a cigarette cartoner machine.

Another object of the present invention is to provide a method and apparatus for repetitively and accurately placing printed indicia upon an outer portion of cigarette packaging at operational machine speeds.

Still another object of the present invention is to provide a method and apparatus for applying printed indicia upon exterior portions of a cigarette carton such that ink smears upon the packaging and cartoner machinery is avoided.

Yet another object of the present invention is to provide such a printing method and apparatus in which the printing operation is executed while the carton blank is moving at an essentially fixed, measurable velocity.

Still another object of the present invention is to provide a method and apparatus for applying printed indicia upon exterior portions of cigarette packaging such that the zone of printed indicia is moved along a region free of contact with machinery for a time sufficient to allow the ink to dry before the region is contacted during further folding operations.

These and other objects are achieved by the present invention which provides a cigarette cartoner apparatus comprising a folding station configured to wrap a carton blank about a pre-arranged bundle of cigarette packets; means for repetitively dispensing carton blanks along a pathway; a signal generator adjacent a print location along the aforementioned pathway configured to generate a signal indicative of presence of the packaging material as it passes adjacent the printing location; at least one fluid jet print head adjacent the print location and a controller configured to operate the print head responsively to the signal generator, with an additional arrangement within the cartoner defining a contact-free path portion sufficient for ink to dry at the indicia-bearing portion of the carton blank as the carton blank is progressed from the print location toward the folding station.

BRIEF DESCRIPTION OF THE DRAWING

Other objects, advantages and novel features of the present invention will become apparent from the following detailed description of the preferred embodiment, when considered in conjunction with the accompanying drawing, wherein.

DETAILED DESCRIPTION OF THE PREFERRED EMBODIMENT

Figure 1:
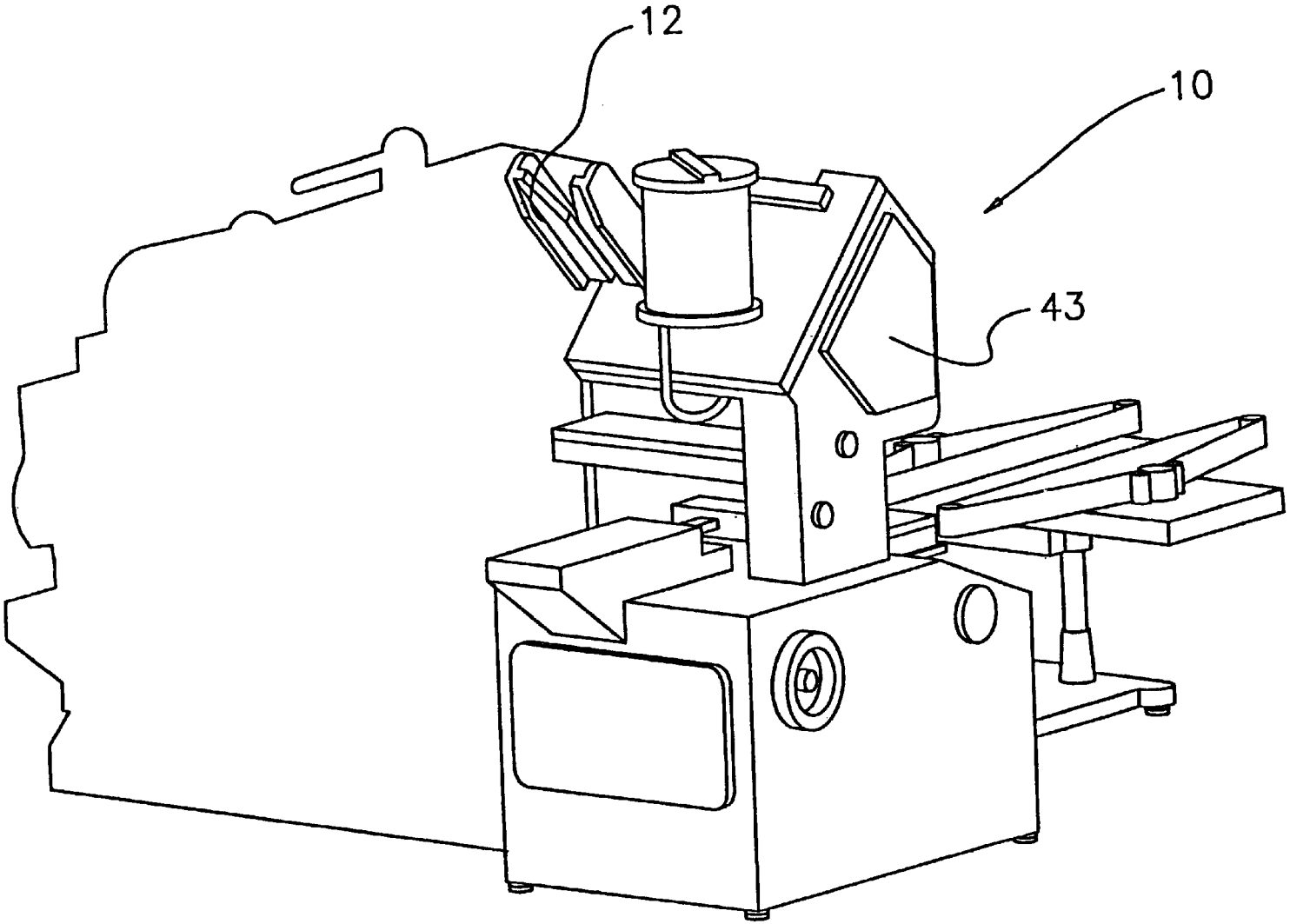
FIG. 1 is a perspective view of a cigarette cartoner module modified in accordance with a preferred embodiment of the present invention.
Figure 4:
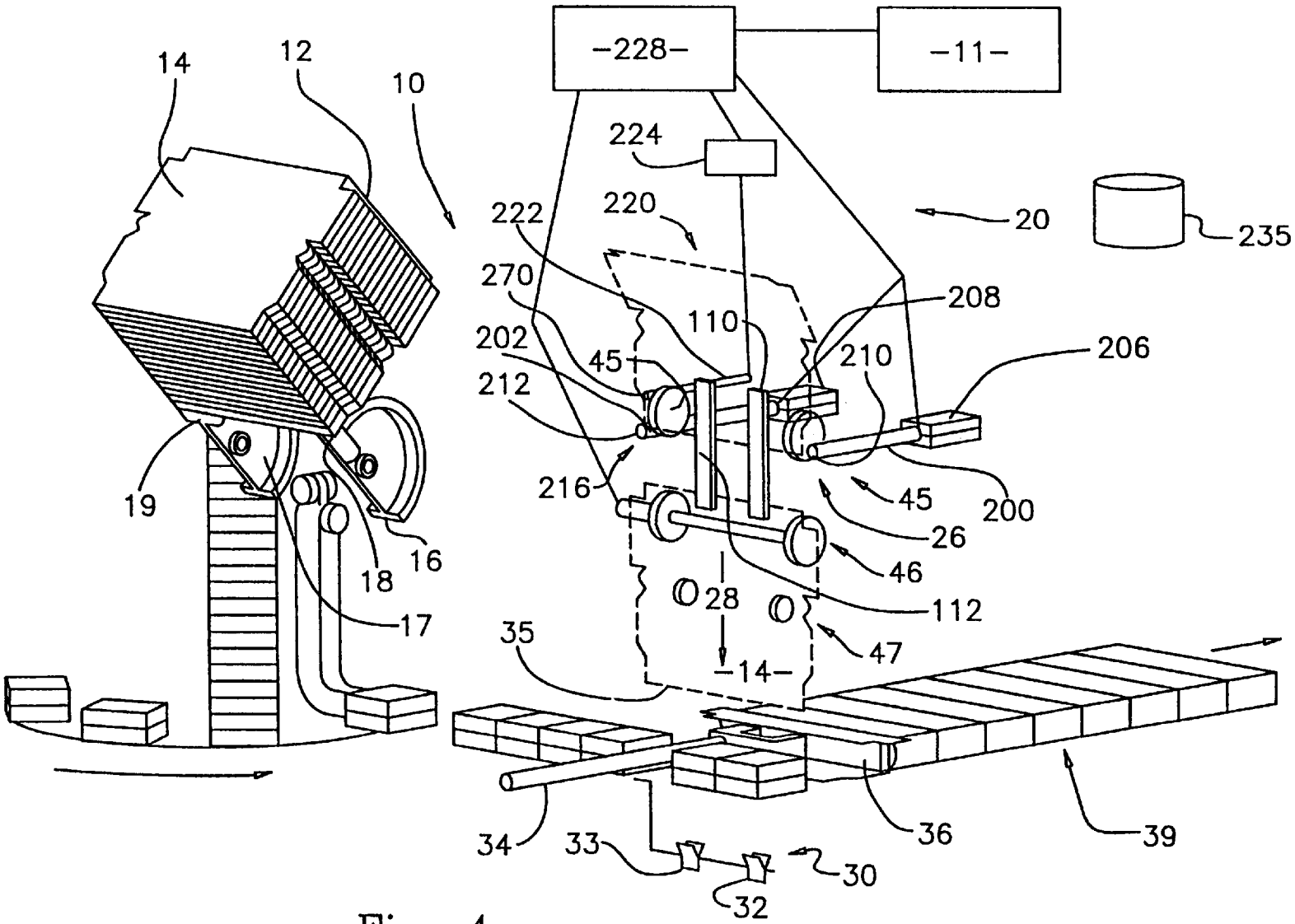
FIG. 4 is a perspective schematic of the preferred embodiment of the present invention showing elements of the ink jet coder system for printing pre-selected indicia upon the cigarette carton of FIG. 2.

Referring to FIGS. 1 and 4, the present invention provides a cigarette cartoner apparatus 10 that has been modified to include an ink jet coder system 20 in accordance with a preferred embodiment of the present invention. Preferably, the cartoner apparatus 10 comprises a G. D 4350 PACK/B-OW cartoner machine manufactured and sold by G. D Societa per Azioni of Via Pomponia 10, 40100 Bologna, Italy, although the teachings which follow may be readily applied to other commercially available cartoner machines upon a reading and understanding of the detailed description which follows.

The cartoner apparatus 10 includes a magazine 12 from which is dispensed individual planar carton blanks 14. A pair of carton pick-up rollers 16, 17 adjacent the magazine 12 carry pneumatically operable, suction cups 18, 19 that grip the lower most carton blank 14 from the magazine 12 as the carton rollers 16, 17 are positioned as shown in FIG. 4. Thereupon, the pick-up rollers 16, 17 rotate and translate such that the lower-most carton blank 14 is delivered to a series of rollers comprising a transfer roller system 26. The transfer roller system 26 is arranged to direct the dispensed carton blank 14 along a vertical pathway 28 leading to a first folding station 30 where a pair of catches (stops) 32, 33 receive a leading edge 35 of the carton blank 14.

Figure 2:
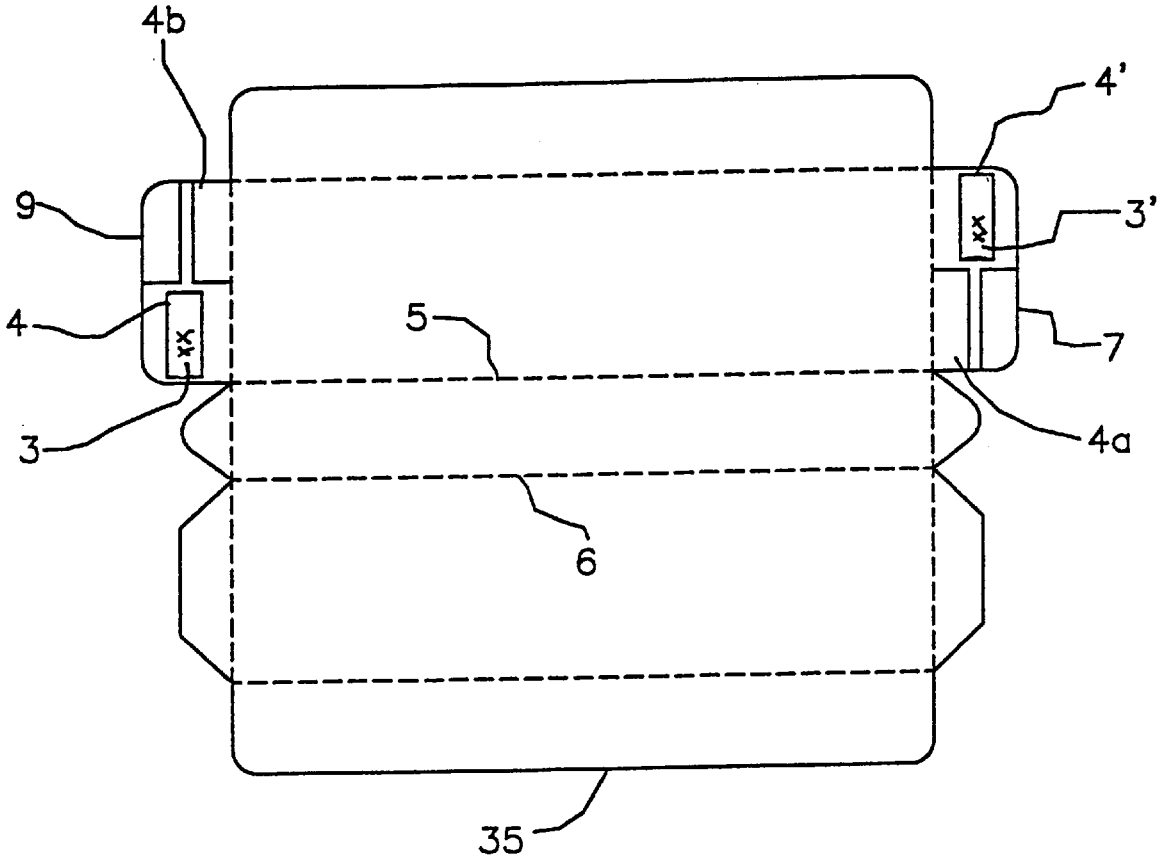
FIG. 2 is a planar view of the print bearing side of a cigarette carton blank modified in accordance with practice of the present invention and bearing pre-selected printed indicia as provided from operation of the machine shown in FIG. 1.
Figure 3:
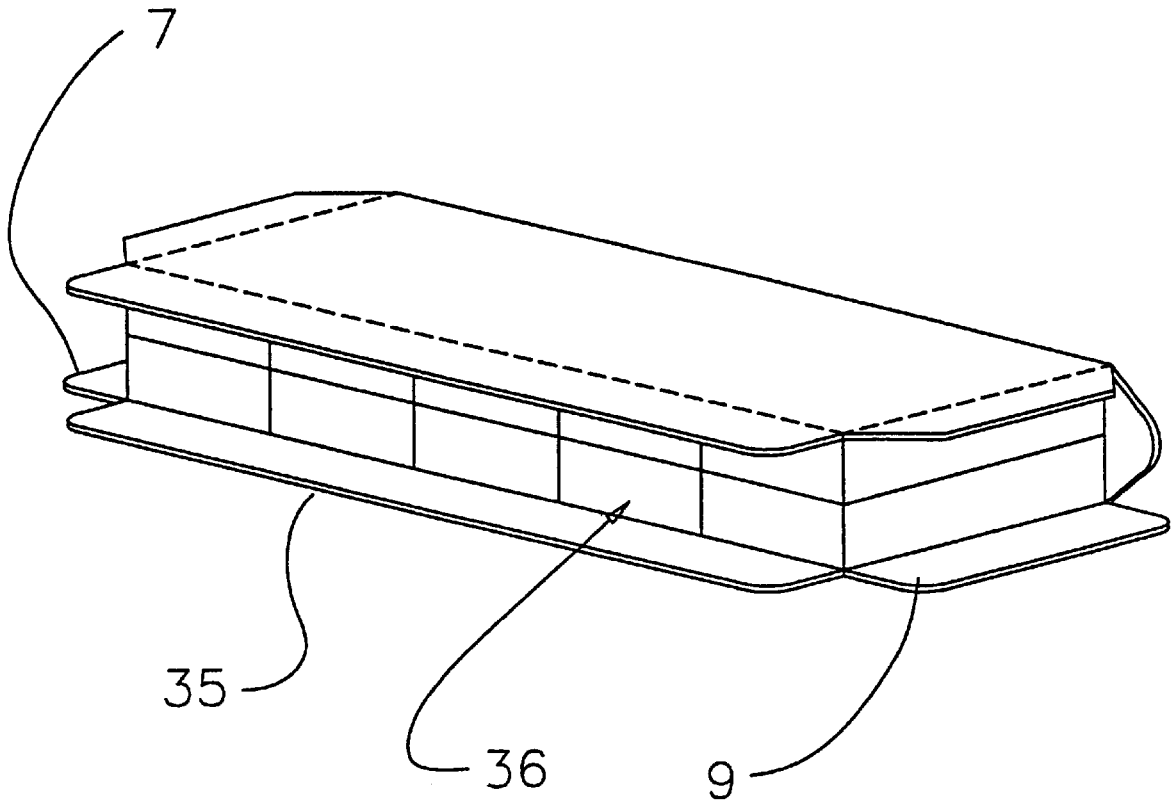
FIG. 3 is a partially folded cigarette carton about a pre-arranged group of ten cigarette packets after they have progressed through the first folding station of the machine shown in FIG. 1.

Referring now to FIGS. 2 and 4, the transfer roller system 26 includes driven rollers and guides such that the dispensed carton blank 14 is moved along a vertical pathway 28 past a pair of print heads 200, 202 of the ink jet coder system 20 at a substantially constant speed. As the carton blank passes by the print heads 200, 202, the ink jet coder system 20 applies printed indicia 3, 3' at pre-selected locations 4, 4' on the carton blank 14. Upon arrival of the blank 14 at the first folding station 30, a plunger 34 pushes a pre-arranged collection of cigarette packets 36 into the received carton blank 14, thereby initiating the folding of the carton blank 14 about the prearranged cigarette packets 36 at the score lines 5, 6. The result of this first folding operation is shown in FIG. 3. Further folding actions and applications of adhesive are undertaken as the carton is progressed along the exit station 39 of the cartoner machine 10 such that flap portions of the carton blank 14 are secured in their folded positions about the packets 36.

Referring particularly to FIG. 2, the printed indicia 3, 3' preferably comprise characters that encode information such as the date and/or place of manufacture, work shift or machine, brand type or other pre-selected bits of information. Preferably, the printed indicia 3, 3' are applied to the outer end flaps 7, 9 of the carton blank 14 at locations that minimize interference with the original decorative or informative printing along the end flaps 7, 9. Preferably, the pre-selected locations 4, 4' are surface treated, such as being scored, so that they readily retain the ink received from the ink jet printer system 20. The pre-selected locations 4, 4' may be situated in places other than that specifically shown in FIG. 2, such as at locations 4*a* and/or 4*b*, or upon an entirely different portion or panels of the blank 14.

Figure 5:
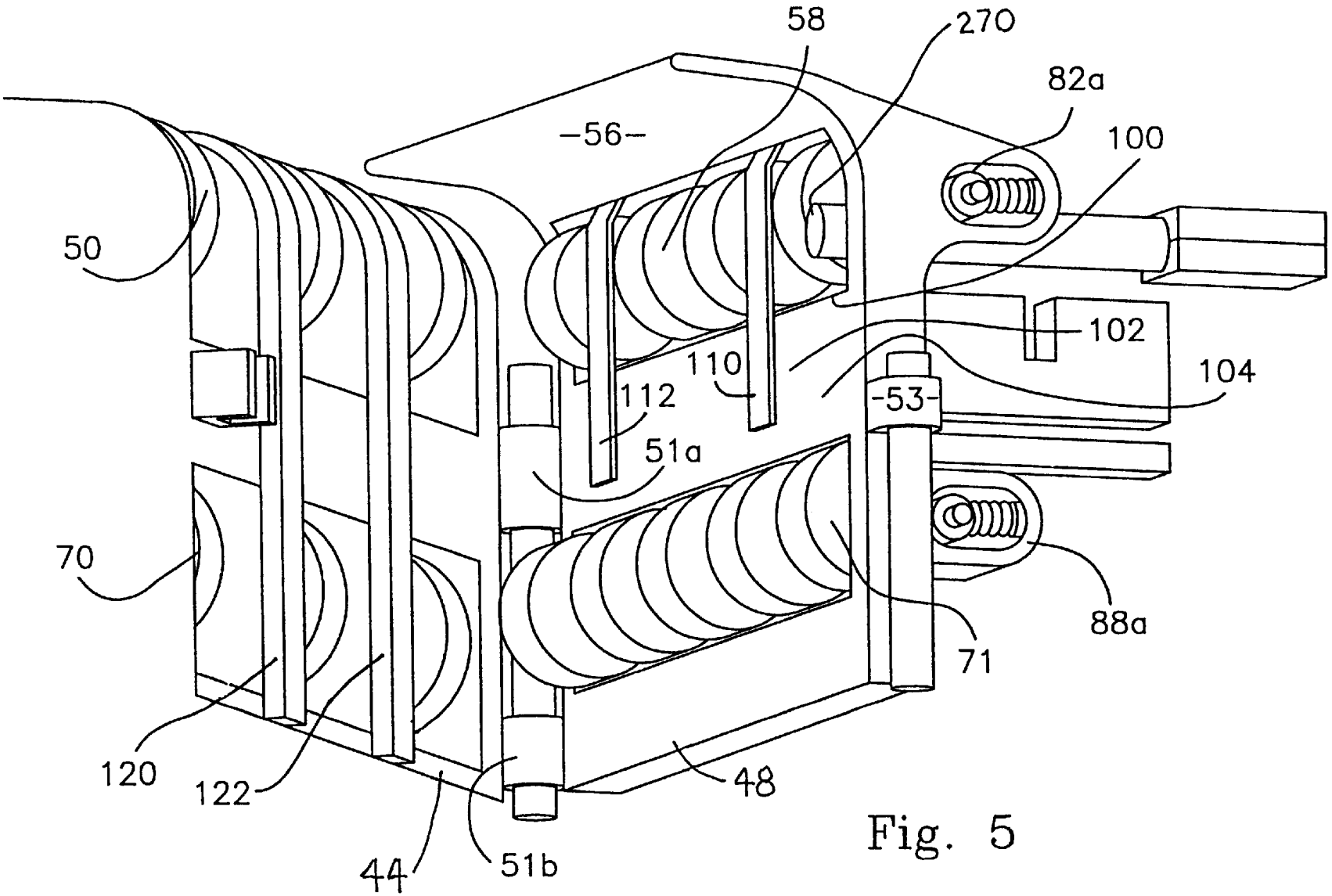
FIG. 5 is a perspective view of the transfer roller system and the coder system shown in FIG. 4.
Figure 6:
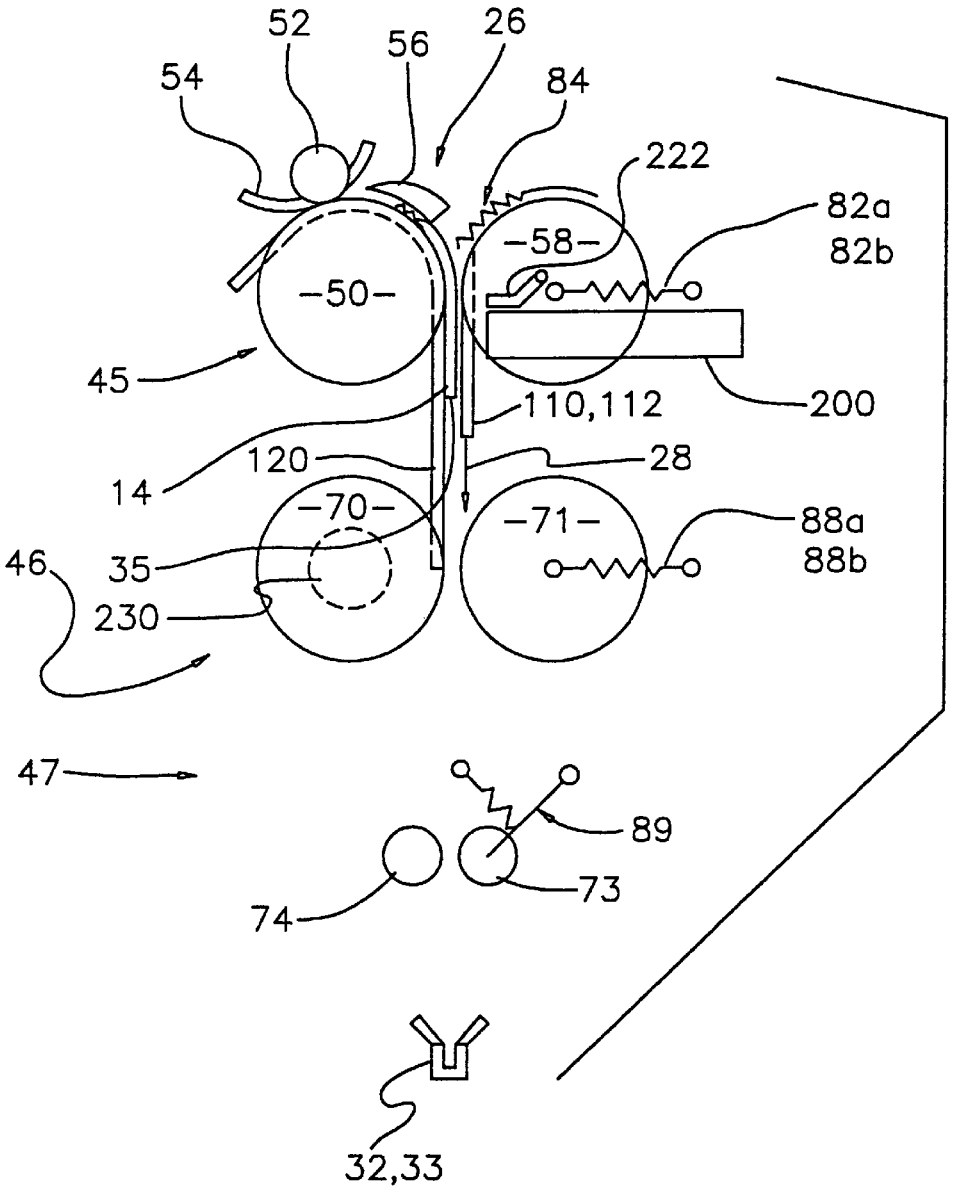
FIG. 6 is a side view-schematic of the roller and coder systems shown in FIG. 5.

Referring now to FIGS. 5 and 6, the vertical pathway 28 leading to the folding station 30 is preferably defined between first, second and third pairs of opposing sets of rollers 45, 46 and 47 that are provided on a fixed housing portion 44 and an opposing, pivotally mounted housing frame 48 of the cartoner apparatus 10. The first, second and third pairs of rollers 45, 46 and 47 are disposed at vertically spaced locations along the vertical pathway 28. Preferably, the pivotal housing frame 48 is supported off the fixed housing 44 at hinges 51*a*, 51*b*, and a latch 53 or other suitable connection that allows access between the housing 44 and frame 48 for purposes of maintenance, repair or removal of jams.

Preferably, the first pair of opposing sets of rollers 45 includes a set of upper drive rollers 50 provided at an upper portion of the fixed housing 44 and an opposing set of upper driven rollers 58 of the pivotal housing frame 48. Preferably the upper set of drive rollers 50 of the housing 44 are drivingly linked to the central drive and control system 11 of the cartoner machine 10. Preferably, the upper set of rollers 58 of the pivotal housing frame 48 are drivingly connected with the upper set of drive rollers 50 of the housing 44 through a pair of meshed gear wheels 84 or other suitable drive connection.

Referring particularly to FIG. 6, the upper set of driven rollers 50 of the housing 44 also cooperate with a set of pinch rollers 52 and guides 54 to receive the leading edge 35 of a dispensed carton blank 14, whereupon the dispensed carton blank 14 is urged arcuately about the upper set of drive rollers 50. The upper set of rollers 50, in cooperation with a guide flange 56 provided atop the pivotal housing frame 48, direct the dispensed carton blank 14 into the vertical pathway 28. This latter action is assisted and further directed by the nip defined between the upper sets of rollers 50 of the housing 44 and the rollers of the frame 48.

The middle pair of opposing sets of rollers 46 comprise a row of driven rollers 70 mounted to the fixed housing 44 and an opposing set of biased idler rollers 71 of the pivotal frame 48. As with the upper driven rollers 50, the middle driven rollers 70 are linked to the central machine drive and control system 11 through the gear box 43 of the housing.

The third, lowest-most pair of opposing sets of rollers 47 preferably comprises a third, lower-most set of driven rollers 74 of the fixed housing 44 and an opposing set of biased idler rollers 73 of the pivotal housing frame 48. The driven rollers 74 receive drive through the connections and transmission of the gear box 43.

The upper set of driven rollers 58 the pivotal housing frame 48 are biased toward the upper driven rollers 58 of the fixed housing 44 by the action of the spring bias assemblies 82*a* and 82*b* located at opposite ends of the upper driven rollers 58.

The middle set of idler rollers 71 of the pivotal housing frame 48 are biased toward the middle set of driven rollers 70 of the fixed housing 44 by the action of second bias assemblies 88*a* and 88*b* at opposite ends of the middle set of idler rollers 71; and torsional arrangements 89*a* and 89*b* biase the third set of idler rollers 73 toward the third set of driven rollers 74 of the fixed housing 44.

Accordingly, after a carton blank 14 is caused to turn about the periphery of the upper driven roller 50, the carton blank 14 is directed downward along the vertical pathway 28 between the nips defined between the opposing sets of rollers 45, 46 and 47. Additionally, vertical guides 120 and 122 are provided along the fixed housing 14 to help maintain proper orientation and direction of the blank 14 during its traverse along the pathway 28.

Referring particularly to FIG. 5, the pivotal housing frame 48 includes a rectangular opening 100 through which segments of the upper driven set of rollers 58 of the housing frame 48 partially protrude. A cross-piece frame portion 102 is situated immediately below the driven rollers 58 and has a generally planar surface portion 104 disposed generally parallel to that of the plane defined by a carton blank 14 as it traverses along the vertical pathway 28. It is along the frame portion 102, the surface 104 and those below it which may suffer ink smears or the like in the absence of practices in accordance with the teachings of the present invention.

To overcome such problems, the ink jet coder system 20 of the present invention includes a pair of parallel, vertically extending guides 110, 112 that are provided adjacent the cross-piece frame portion 102 of the housing frame 48.

Figure 7:
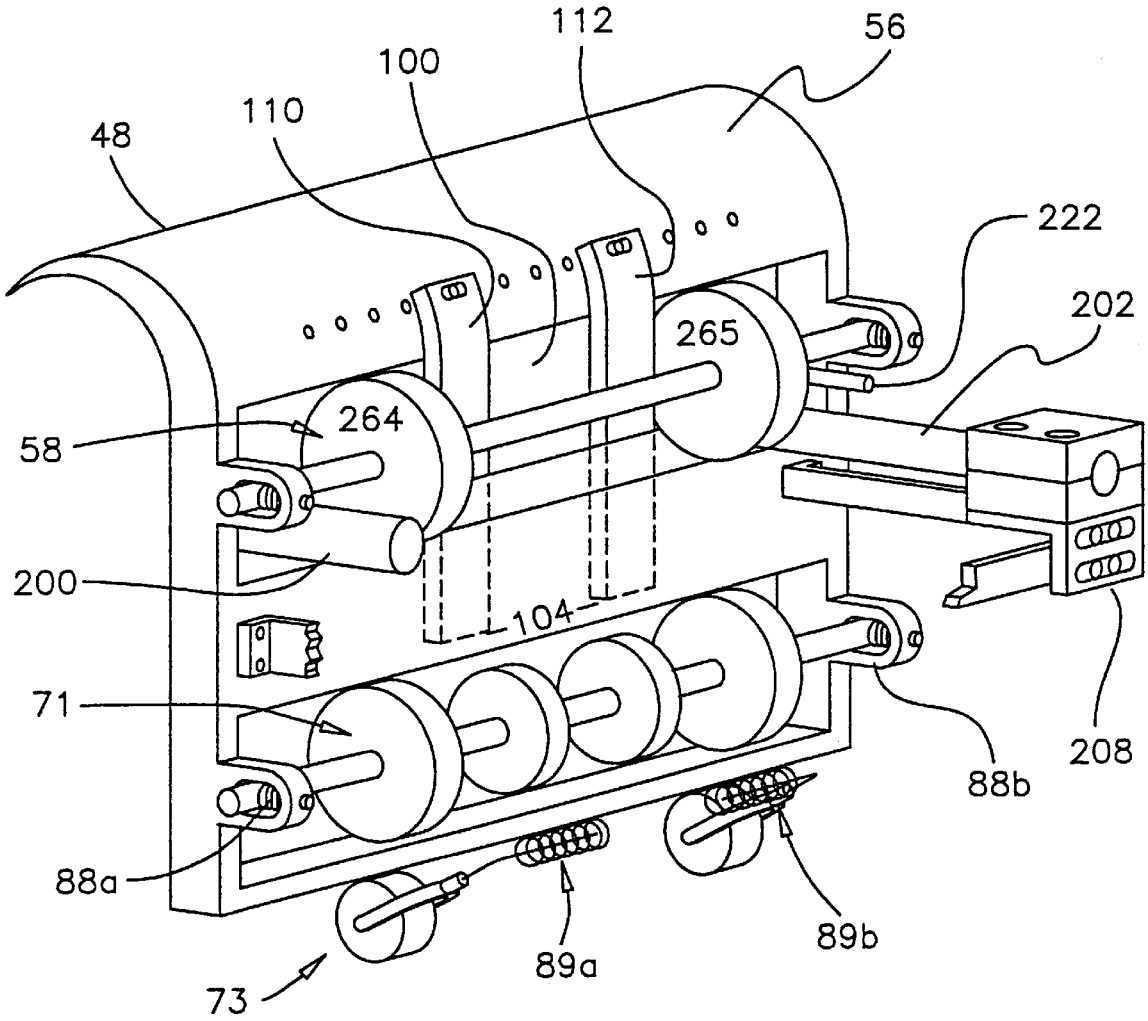
FIG. 7 is a rear-perspective view of the housing frame portion of the transfer roller assembly shown in FIG. 5.

Referring now to FIGS. 5 and 7, preferably, the guides 110, 112 are suspended vertically from a backside portion of the arcuate guide flange 56 of the housing frame 48 and extend vertically across the rectangular opening 100 and at least partially across the lower frame portion 102 beneath the upper driven rollers 58. Preferably, the lateral positioning of the guides 110 and 112 is such that they avoid interference with the upper driven rollers 58 of the pivotal housing frame 48 and such that they are situated in a generally opposing relation to the guides 120 and 122 disposed vertically along the fixed housing 44. More preferably, at least one or both of the guides 110 and 112 are placed laterally outside of the guides 120, 122 of the fixed housing 44, such that each guide 110, 112 lies closer to the more adjacent vertical edge of the housing frame 48 than does the adjacent guide 120, 122. It is believed that such displacement imparts a slight bowing action upon a passing carton blank 14, which helps keep the pre-selected printed portions 4, 4' of the carton blank 14 free from contact with the cross-piece portion 102 and other portions of the transfer roller system 26.

If so displaced, the guides 110, 112 are preferably displaced sufficiently far from the guides 120, 122 of the fixed housing 44 so that their opposing edges do not create a pinch that might otherwise snag and skew a passing cigarette carton 14. To avoid pinching, the guides 110, 112 on the housing frame 48 should be laterally displaced at least 20 millimeters or more from the adjacent guide 120, 122 of the fixed housing 44. Additionally, the lateral positioning of the guides is to be adjusted to avoid any scuffing action on passing carton blanks 14 and any interference with rollers.

Preferably, the guides 110, 112 are 13 guage in thickness, approximately 190 millimeters long (at least long enough to at least partially extend across the cross-piece 102 of the housing frame 46) and approximately 140 to 180 mm apart, preferably about 160 mm apart.

Upon entering the vertical pathway 28, the carton blank 14 tends to remain at a constant speed until arrival at the stops 32, 33 at the folding station 30. As it passes across the opening 100 of the pivotal housing frame 48, the ink jet printer heads 200, 202 of the printing system 20 applies pre-selected printed indicia 3, 3' upon pre-selected portions 4, 4' of the carton blank 14. Thereafter, the action of the vertical guides 110, 112 maintains the indicia bearing portions 4, 4' of the carton blank 14 out of contact with the cross-piece 102 of the housing frame 48 and other portions of the cartoner machine 10 as it continues along its downward progression along the vertical pathway 28 to the first folding station 30, such that the applied ink comprising the printed indicia is allowed sufficient time to dry in a smear-free condition.

Referring now to FIGS. 2 and 3, the ink jet coder system 20 further comprises a pair of ink jet printing heads 200, 202 located adjacent opposite ends of the set of upper driven rollers 50 of the frame 48. Preferably, each printer head 200, 202 is secured to the backside of the housing frame 48 with a laterally adjustable mount 206 and 208, respectively, such that the lateral placement of the ink jet printer heads 200, 202 can be adjusted individually so as to accommodate changes in carton size and/or target location of the printed indicia 3, 3'. Preferably, the ink jet printer heads 200, 202 are positioned such that as a carton blank 14 travels along the vertical pathway 28, the discharging ports 210, 212 of the ink jet printers 200, 202 are vertically aligned with the selected target locations 4 4' on the carton blank 14, preferably at the end flaps 7, 9 of the blank 14. The location along the vertical pathway 28 at which the discharge ports 210, 212 of the ink jet printer heads 200, 202 are operative is hereafter referenced as the print location 216 along the vertical path portion 28.

Preferably, the ink discharging parts 210, 212 of the ink jet printing heads 200, 202 are located adjacent the outermost rollers 264, 265 of the upper, driven set of rollers 58 of the housing frame 48, but might be positioned elsewhere along the set of rollers 45 so as to meet needs of the desired printing operations. Preferably the ink discharging parts 210, 212 of the ink jet printing heads 200, 202 protrude slightly through the opening 100 of the housing frame 48 so as to minimize spacing between the printer heads 200, 202 and the target portions 4,4' of the blank 14.

Ink is supplied to each ink jet printer head 200, 202 from a reservoir 235, whose level is monitored by the controller 228 of the ink jet printer system 20. Preferably, the ink supplied and discharged from the ink jet printer head 200, 202, is a quick-drying, water-based ink Number 99-4520 Q which is available from Videojet Systems International, Inc. of Wood Dale, Ill. 60191-1073.

The ink jet coder system 20 further includes a product detect sensor system 220 preferably comprising an optical pipe 222 linked to an optical sensor 224 which is arranged to generate a signal upon detection of a change in light intensity received from the optical pipe 222. This indicative signal is communicated to the print controller 228 of the ink jet printing system 20. Both the sensor system 220 and the controller is obtainable from Videojet Systems International, Inc. of Wood Dale, Ill. 60191-1073. The light receiving end 270 of the optical pipe 222 is directed toward the fixed housing 44 through the opening 100 of the housing frame 48 and is affixed to the housing frame 48 with a bracket or other suitable device. It is so held in a fixed position preferably adjacent one of the ink jet printing heads 200, 202, preferably immediately above same.

A suitable commercially available product suitable for use as the sensor 224 is a Tri-tronics Photoeye SER-FI. A commercially available Fiber Optic-Cable BF-B-36T and lens (UAC-5) may be used for the optical pipe 222.

During operation of the cartoner machine 10, the optical pipe 222 communicates ambient light to the sensor 224, which circumstance generates a signal indicative of an absence of a carton blank 14 at the print location 216 along the vertical pathway 28. Upon arrival at the location of the optical pipe 222, the leading edge 35 of the carton blank 14 causes a change in light intensity at the receiving end 270 of the optical pipe 222. As a result, the sensor 222 communicates a signal to the controller 228 that a carton blank is about to arrive at the print location 216.

The ink jet coder system 20 further comprises a shaft encoder 230, which is preferably affixed to and generates signals responsively to rotation of the shaft carrying the middle driven rollers 70 of the fixed housing 44, but may in the alternative, be operatively connected with other driven rollers such as the upper set driven rollers 50 or the third set 74. The output signal of the shaft encoder 230 is communicated to the print controller 228 of the ink jet coder system 20 for the processing and execution of commands by the print controller 228 to the ink jet printer heads 200, 202.

Additionally, the controller 228 is linked to the central drive and control system 11 of the cartoner machine 10 such that the controller 228 receives signals indicative of the machine being "on/off," and if available, to an internal shaft encoder of the central drive and control system 11 of the cartoner machine 10.

Preferably, the controller 224 comprises a Videojet ES 273 SE from the same Videojet Systems International, Inc. of Wood Dale, Ill.

The print controller 228 and system controller 11 are configured to operate the system as follows: once the cartoner machine 10 is powered up and the printer control box 228 is ready to print, the cartoner 10 is allowed to start normally. If the printer at any time is unable to print due to such factors as loss of power, low ink supply or make-up levels or other internal fault, the controller 11 shuts down the cartoner machine 10. A warning light is illuminated prior to shut down to indicate the aforementioned conditions, so as to facilitate corrective action by the operator.

When the packaging machine 10 is operating, the print controller 228 receives a signal from the product detect sensor 224 and a second signal from the shaft encoder 230. From processing these signals, the controller 228 of the ink jet coder system can resolve when a dispensed carton blank 14 will arrive at the print station 216 and how fast it is moving. With such information, the controller 228 executes a printing operation such that the encoded information is placed upon the packaging piece 25 consistently, both as to its placement, character size and layout.

In the printer heads 200, 202, ink is dispensed droplet by droplet in accordance with known fluid jet technologies, wherein ink is sent under pressure to an emitter having a nozzle, while at the same time a piezoelectric device (resonator) transmits acoustic vibration to the jet, causing the jet of ink to break up into droplets of a consistent size, such as approximately 70 microns or thereabouts. Typically, one or more electrodes adjacent the jet at the break-off point apply a charge proportional to the voltage applied to the electrodes.

The charged droplets are then directed between deflection plates between which an electrical potential is maintained. The droplets are thus deflected from their initial trajectory proportionately to their electrical charge. Any uncharged droplets are captured in a trap and recycled in the ink reservoir.

The combination of the drop deflection and of the object movement perpendicular to this deflection enables writing of all kinds of patterns, notably characters, on any substrate regardless of its nature.

Thus, it is provided an apparatus and method for manufacturing cigarette cartons featuring ink jet coding. One skilled in the art will appreciate that the present invention can be practiced by other than the preferred embodiments, which are presented for purposes of illustration and not limitation, and the present invention is limited only by the claims that follow.

What is claimed is:

1. A cartoner apparatus comprising:

a folding station configured to at least partially wrap a carton blank about a pre-arranged bundle of packets;

means for repetitively dispensing carton blanks along a pathway extending from a source of said carton blanks to said folding station, said pathway including a path portion adjacent said folding station;

a signal generator adjacent a print location along said path portion, said signal generator configured to generate a signal indicative of presence of said carton blank as said carton blank passes adjacent said print location;

at least one fluid jet printer head at said print location; and a controller configured to operate the printer head responsively to the signal generator, said controller configured to operate said fluid jet printer head to repetitively apply selectable indicia on a pre-selected portion of said carton blank as said carton blank passes said print location;

said dispensing means including a roller assembly at a location along said path portion proximate to said folding station, said roller assembly including a frame member disposed between said print location and said folding station, said fram member proximate to said pre-selected, indicia bearing portion of said carton blank as said carton blank passes through said roller assembly, said roller assembly including a guide arrangement adjacent said frame member and operative upon said blank as said blank is progressed through said roller assembly from said print location into the folding station such that said indicia-bearing portion of said blank remains without contact with said frame member during said progression through said roller assembly.

2. The cartoner as claimed in claim 1, wherein said guide arrangement comprises at least a pair of elongate, mutually parallel rails extending in the direction of said pathway, said fluid jet printer head comprising first and second printer heads disposed laterally outside of said rails.

3. The cartoner as claimed in claim 1, wherein said path portion is vertically inclined.

4. A cartoner apparatus comprising:

a folding station configured to at least partially wrap a carton blank about a pre-arranged bundle of packets;

a transfer roller assembly adjacent said folding station and arranged to guide said carton blank along a pathway into said folding station, said transfer roller assembly including a frame;

a fluid jet coder system operative at a print location along said pathway, said fluid jet coder system configured to repetitively apply a selectable indicia on a pre-selected portion of said carton blank so that upon activation of said fluid jet coder, said pre-selected portion of said carton blank bears said indicia, said fluid jet coder system comprising:

a print controller;

a fluid jet printer head supported from said frame and located at said print location and in communication with said print controller;

a first sensor adjacent said print location configured to generate a signal indicative of a carton passing through said print location, said first sensor in communication with said print controller;

a second sensor operative to indicate a speed along said pathway, said second sensor in communication with said print controller, a guide extending at least partially along said pathway, said guide configured to urge said pre-selected carton portion apart from adjacent portions of said frame of said transfer roller assembly so that as said carton blank progresses beyond said print location, said pre-selected carton portion is transferred along a guided path portion such that said indicia remains in a non-smeared condition.

5. The cartoner apparatus as claimed in claim 4, wherein said guide comprises at least a pair of elongate, mutually parallel rails extending in a direction of said pathway, said fluid jet printer head comprising first and second printer heads disposed laterally outside of said rails.

6. The cartoner as claimed in claim 4, wherein said pathway includes a vertically inclined path portion adjacent said folding station.

7. A method of printing on a carton, said method comprising the steps of:

dispensing an individual carton blank to a transfer roller assembly;

delivering said dispensed carton blank to a folding station from said transfer roller assembly along a guided pathway;

sensing a speed of said dispensed carton blank as said blank transfers through said transfer roller assembly;

sensing when a dispensed carton blank is passing through a print location along said transfer roller assembly;

operating a fluid jet printer head at said print location responsively to said first and second sensing steps, so as to apply selectable indicia on a pre-selected portion of said carton blank as said carton blank passes through said print location; and maintaining said indicia-bearing pre-selected portion of said carton blank free of contact with said transfer roller assembly so that said printed indicia is delivered from said roller assembly to said folding station in a non-smeared condition along a guided pathway.

8. A cartoner apparatus comprising:

a folding station configured to at least partially wrap a carton blank about a pre-arranged bundle of packets;

means for repetitively dispensing carton blanks along a pathway extending from a source of said carton blanks to said folding station, said pathway including a path portion adjacent said folding station;

a signal generator adjacent a print location along said path portion, said signal generator configured to generate a signal indicative of presence of said carton blank as said carton blank passes adjacent said print location;

at least one fluid jet printer head at said print location; and a controller configured to operate the printer head responsively to the signal generator, said controller configure to operate said fluid jet printer head to repetitively apply selectable indicia on a pre-selected portion of said carton blank as said carton blank passes said print location;

said dispensing means including a roller assembly at a location along said path portion proximate to said folding station, said roller assembly including a frame member disposed between said print location and said folding station, said frame member proximate to said pre-selected, indicia bearing portion of said carton blank as said carton blank passes through said roller assembly, said roller assembly including a guide arrangement adjacent said frame member and operative upon said blank as said blank is progressed through said roller assembly from said print location into the folding station such that said indicia-bearing portion of said blank remains without contact with said frame member during said progression through said roller assembly;

wherein said guide arrangement comprises a first pair of elongate, mutually parallel rails extending in the direction of said pathway, said fluid jet printer head comprising first and second printer heads disposed laterally outside of said first pair of rails, said guide arrangement further comprising a second pair of elongate, mutually parallel rails extending in the direction of said pathway, said first and second pair of rails in a mutually opposing relation so as to receive said blank therebetween, said second pair of rails transversely displaced from said first pair of rails so as to induce a bowing action upon said blank passing therebetween.

9. A cartoner apparatus comprising:

a folding station configured to at least partially wrap a carton blank about a pre-arranged bundle of packets;

a transfer roller assembly adjacent said folding station and arranged to guide said carton blank along a pathway into said foldign station said transfer roller assembly including a frame;

a fluid jet coder system operative at a print location along said pathway, said fluid jet coder system configured to repetitively apply a selectable indicia on a pre-selected portion of said carton blank so that upon activation of said fluid jet coder, said pre-selected portion of said carton blank bears said indicia, said fluid jet coder system comprising;

a print controller;

a fluid jet printer head supported from said frame of said transfer roller assembly and located at said print location and in communication with said print controller;

a first sensor adjacent said print location configured to generate a signal indicative of a carton passing through said print location, said first sensor in communication with said print controller;

a second sensor operative to indicate a speed along said pathway, said second sensor in communication with said print controller, a guide extending at least partially along said pathway, said guide configured to urge said pre-selected carton portion apart from adjacent portions of said frame of said transfer roller assembly so that as said carton blank progresses beyond said print location, said pre-selected carton portion is transferred along a guided path portion such that said indicia remains in a non-smeared condition;

wherein said guide comprises a first pair of elongate, mutually parallel rails extending in the direction of said pathway, said fluid jet printer head comprising first and second printer heads disposed laterally outside of said first pair of rails, said guide further comprising a second pair of elongate, mutually parallel rails extending in the direction of said pathway, said first and second pair of rails in a mutually opposing relation so as to receive said blank therebetween, said second pair of rails transversely displaced from said first pair of rails so as to induce a bowing action upon said blank passing therebetween.

* * * * *